US006926428B1

(12) United States Patent
Lee

(10) Patent No.: US 6,926,428 B1
(45) Date of Patent: Aug. 9, 2005

(54) WORKLIGHT CASE

(75) Inventor: Wade Lee, Danville, CA (US)

(73) Assignee: EML Technologies LLC, Danville, CA (US)

( * ) Notice: Subject to any disclaimer, the term of this patent is extended or adjusted under 35 U.S.C. 154(b) by 0 days.

(21) Appl. No.: 10/281,051

(22) Filed: Oct. 25, 2002

Related U.S. Application Data

(60) Provisional application No. 60/347,507, filed on Oct. 25, 2001.

(51) Int. Cl.[7] ..... A45C 15/06
(52) U.S. Cl. ..... 362/431; 362/154; 362/413
(58) Field of Search ..... 362/431, 414, 362/413, 418, 199, 154, 156, 376; 190/109, 190/108; 206/372, 573

(56) References Cited

U.S. PATENT DOCUMENTS 5,779,350 A * 7/1998 Chang ..... 362/154
5,964,524 A * 10/1999 Qian ..... 362/414

OTHER PUBLICATIONS

Photo of worklight and case, on sale prior to Oct. 2000.

* cited by examiner

*Primary Examiner*—Sandra O'Shea
*Assistant Examiner*—Guiyoung Lee
(74) *Attorney, Agent, or Firm*—Elliot B. Aronson

(57) ABSTRACT

An improved worklight case for carrying and storing a worklight such as a quartz halogen worklight having a protective grill protruding from the worklight face. The worklight may be stored in the case without disassembly of the worklight or removal of the protective grills. A tripod may also be included in the case. The case has a bottom portion including one or more bays, each of which is formed for receiving an individual worklight head with the protective grill in position on the worklight head. The bays are disposed in the bottom portion so that each worklight head rests in its own bay when the worklight is in position in the bottom portion. The various surfaces of the bottom portion are formed to allow space for the worklight base so that the worklight heads need not be disassembled from the base, but rather the worklight may be positioned in the bottom portion as a unit with each head in its own bay. Adequate space is left over for storing the tripod as well.

3 Claims, 5 Drawing Sheets

WORKLIGHT CASE

This application claims priority in provisional application No. 60/347,507 filed Oct. 25, 2001.

BACKGROUND OF THE INVENTION

The present invention relates to portable worklights and cases for storing and carrying the worklights when not in use.

Portable worklights have proved useful in a variety of settings such as construction sites, industrial plants, automotive and auto body repair shops, artist and photographic studios, and around the home for do-it-yourself projects. These lights provide a high level of illumination over an extended area. The worklights are either set on a low, typically built-in supporting stand that can be placed in a stable position on the ground or other work surface or they are secured to an upright stand such as a tripod for greater height off the work surface. Examples of such worklights are disclosed in U.S. Pat. No. 5,243,507 of Atkins et al.; U.S. Pat. No. 5,695,278 of Grossman et al.; U.S. Pat. No. 5,845,989 of Leen; and U.S. Pat. No. D381,114 of Xu.

In some applications, such as construction projects, worklights are used so commonly that they are considered by many to be indispensable accessories forming a part of the basic assemblage of tools and equipment taken to the construction site as a matter of course. Worklights tend to be bulky, particularly the so-called dual head worklights that have two separate worklight heads mounted on a common base. In the past the worklights have typically been carried to and from the job site as is. The stand-alone units are simply carried by the handle on the worklight, and the tripod-mounted units are either carried as a whole with the worklight mounted on the tripod or the worklight is removed from the tripod and the worklight and tripod are carried separately. In transporting the worklights, for example in the back of a pickup truck, and in storing the worklights, the units are exposed to unwanted wear and tear and possible damage because they have no protection. To avoid these disadvantages, at least one known worklight comes in a case that requires the worklight to be disassembled to be packed in the case. In particular, the individual worklight heads and carrying handle are removed from their stand and the protruding protective grills on the worklights are removed before the unit can be fit in the case. While this may make for a more compact case, it is inconvenient to disassemble the worklight every time it is desired to store the unit and then have to reassemble it before use.

SUMMARY OF THE INVENTION

The present invention provides an improved worklight case for carrying and storing a worklight. In particular, a case according to the invention does not require disassembly of the protective grills before the worklight is stored in the case and may be configured so as to require little or no disassembly of the worklight at all before being packed into the case. For worklights that are used with a tripod, the tripod may also be conveniently located in the case generally detached from the worklight. This provides a great convenience to the user in that the worklight may be removed from the case ready for use with little or no assembly required and can be packed into the case just as quickly and conveniently. Moreover, the unit is stored in the case in a manner protecting against damage to the worklight heads during transport.

Briefly, a case according to the invention has a bottom portion including one or more bays, each of which is formed for receiving an individual worklight head with the protective grill in position on the worklight head. The bays are disposed in the bottom portion so that each worklight head rests in its own bay when the worklight is in position in the bottom portion. The various surfaces of the bottom portion are formed to allow space for the worklight base so that the worklight heads need not be disassembled from the base, but rather the worklight may be positioned in the bottom portion as a unit with each head in its own bay. Adequate space is left over for storing the tripod and cord as well. This arrangement is particularly desirable with high-voltage halogen worklights, which are known to generate much heat and which are generally required to have a protruding protective grill to guard against fire hazard. Consequently halogen worklights tend to be bulkier and have not heretofore been available with a carrying case that did not require disassembly of the protective grill and other components.

Other aspects, advantages, and novel features of the invention are described below or will be readily apparent to those skilled in the art from the following specifications and drawings of illustrative embodiments.

DETAILED DESCRIPTION OF ILLUSTRATIVE EMBODIMENTS

Figure 1:
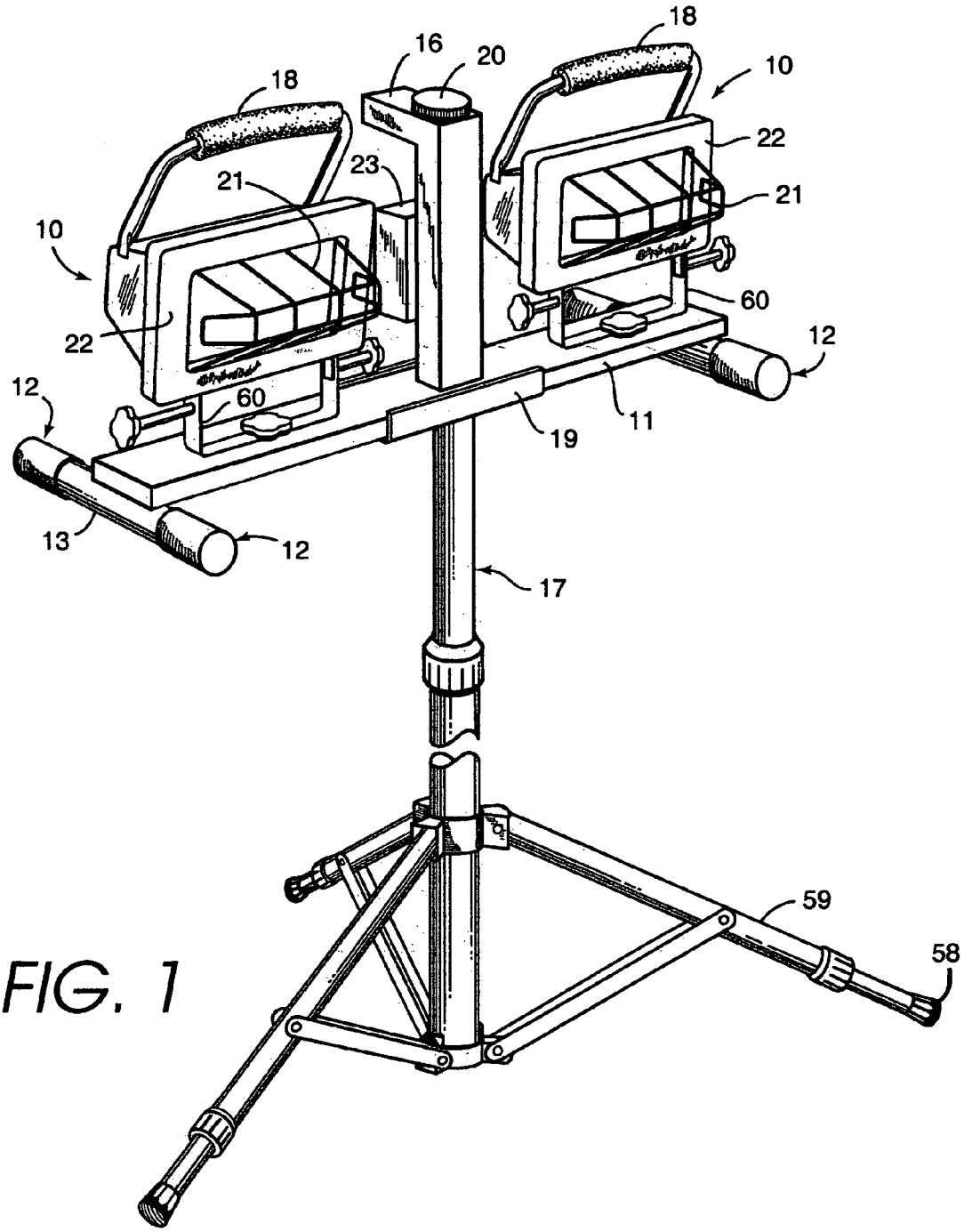
FIG. 1 is an overall view of a typical dual-head worklight mounted on a tripod of a sort to be transported in a case according to the invention.

FIG. 1 shows a typical worklight to be packed into a case according to the invention. The worklight assembly includes a pair of worklight heads 10 that are mounted on a horizontally extending support member 11 that in turn includes two pairs of support feet 12 formed by the distal ends of two tubular members 13 extending transversely to support member 11. The feet are formed and disposed to engage the work surface and provide support for the worklight assembly when the assembly is used as a stand-alone unit. A centrally disposed handle 16 is secured to horizontally extending support member 11 both for carrying the worklight assembly about when used as a stand-alone unit and for facilitating mounting on a tripod 17. Each worklight head also includes a handle 18 for aiming the individual head. The tripod is a typical retractable, telescoping-style tripod that may be detached from the worklight. The worklight is removably secured to the tripod at bracket 19 where it is held by a rod that can be tightened and loosened by knob 20. The worklight heads of FIG. 1 each include a protective grill 21 that protrudes in front of a protective glass shield covering the chamber holding the light bulb or bulbs. The front face of the worklight head includes a frame 22 commonly referred to as a bezel. Protective grill 21 is typically secured to the bezel, either integrally or removably. In the illustrated embodiment the worklight includes a built-in dual electrical outlet contained in outlet box 23 shown mounted on the post supporting handle 16. In addition, the worklight includes a length of electrical cord 24 that may typically range from 8 to 12 feet.

A carrying case for the worklight of FIG. 1 is now described and illustrated with reference to FIGS. 2A, 2B, 3 and 4. The case shown here is able to accommodate the twin worklight heads 10 while secured to the base member support 11 with the protruding grills 21 remaining attached to the heads 10 and the bulky electrical outlet box 23 supported on the handle member, all with no disassembly, along with tripod 17 in its retracted, detached configuration and a functional length of electrical cord. The case includes a bottom portion 31 and a top portion 32. The top portion is secured to the bottom portion typically by hinging in the manner of a conventional tool case. Although this is typically achieved with two or more small hinge attachments, such as hinges 33, or one extended hinge attachment, the top and bottom may be secured to one another by any convenient means. For example, instead of the conventional hinge arrangement, in some embodiments it may be desirable to clamp them together around their periphery so that the top may be completely separated when removed. The particular manner in which the top and bottom are joined plays no role in the invention and the manner of securement will be referred to generally herein as "hinged."

The bottom portion includes two bays 34 which are each formed to receive a worklight head with the protective grill secured thereto. For the dual-head worklight illustrated here bottom portion 31 includes two bays 34. In general in accord with the invention the bottom portion will include one such bay for each worklight head and the bays are disposed in the bottom portion so that each head rests in its own bay when the worklight is in its storage position in the bottom portion.

Figure 2A:
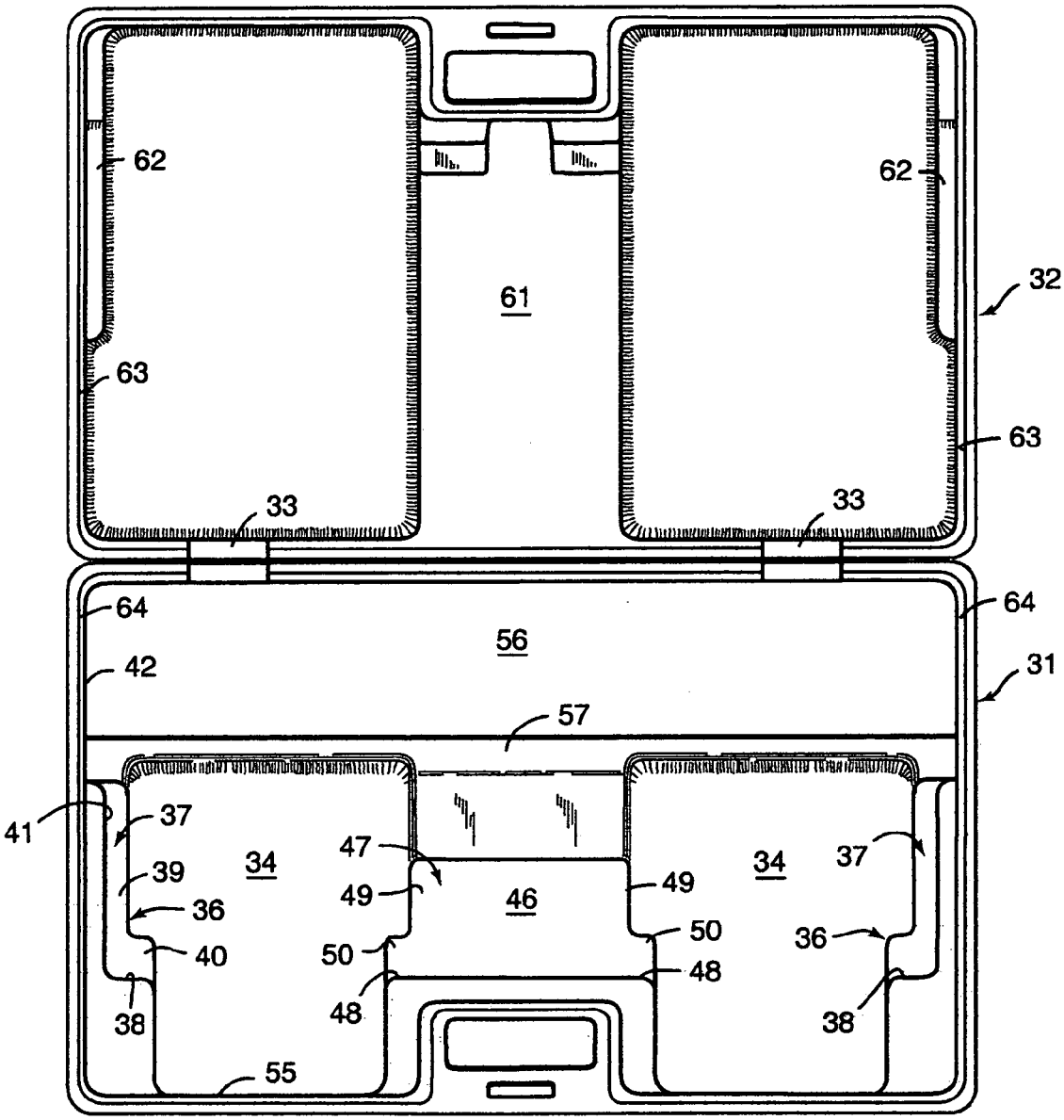
FIG. 2A is a plan view of an embodiment of a case in open configuration according to the invention.
Figure 2B:
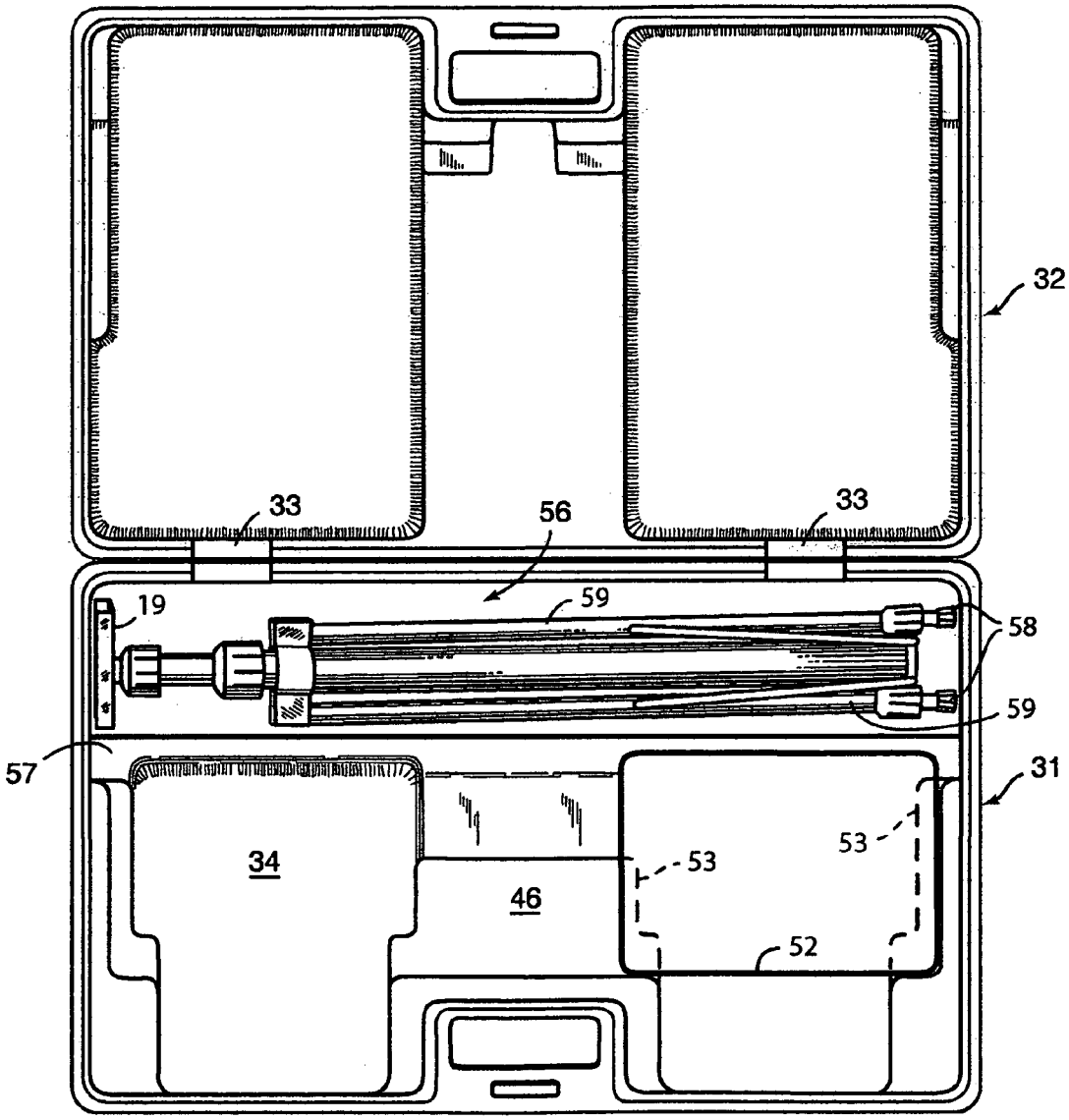
FIG. 2B is the plan view of FIG. 2A showing the position of a worklight head and tripod in the case.
Figure 3:
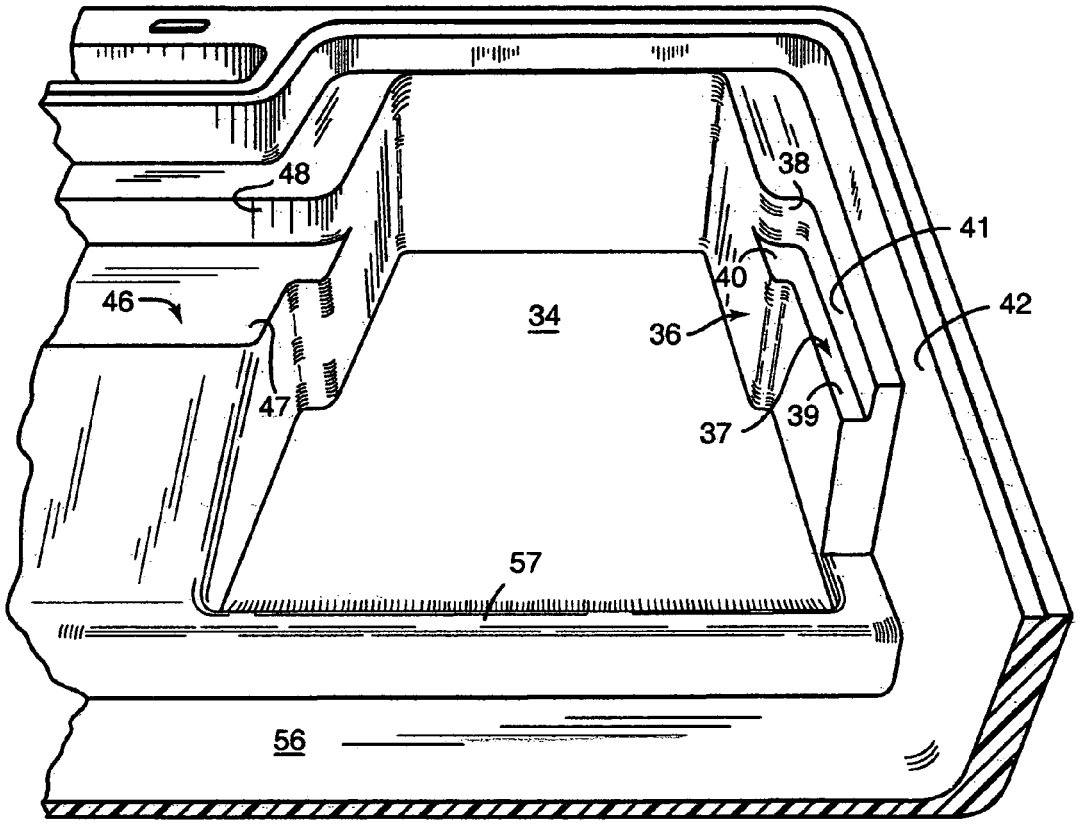
FIG. 3 is a fragmentary perspective view of a bay in the case for receiving a worklight head.

As shown in FIGS. 2A and 3, bay 34 is formed with a side member 36 defining a horizontal surface 37 serving as a rail for supporting the bezel 22 along at least a portion of an edge of the bezel. Side member 36 also defines a vertically rising front stop 38. In the illustrated embodiment horizontal surface 37 is L-shaped with a side leg 39 and a short front leg 40, which extends slightly along the front edge of bezel 22 when the worklight is in position in the case. Side member 36 also defines a wall 41 generally vertically rising from the edge of the horizontal surface of side leg 39. The wall 41 is offset from the interior side wall 42 of the bottom portion by a sufficient amount so that the worklight will be held relatively snug in the case against any substantial sideways movement. The opposite side of bay 34 includes a central member 46 that defines a horizontal surface 47 at the same height as horizontal surface 37 and serving as a rail for supporting the bezel 22 along at least a portion of the opposite edge of the bezel from that supported by the rail 37. Central member 46 also defines a vertically rising front stop 48 and also has an L shape formed by a side leg 49 and a short front leg 50. When the worklight is in position in the case, the top edge of bezel 22 abuts against front stops 38 and 48. One side of the bezel abuts with suitable clearance against offset wall 41, and the opposite side of the other bezel on the other head abuts in a similar manner against a corresponding offset wall at the opposite side of the bottom portion. FIG. 2B shows the outline 52 of bezel 22 resting in position on the horizontal surfaces 37 and 47. The underlying shoulders of the horizontal surfaces are shown by dashed lines 53.

In the illustrated embodiment horizontal surface 47 defined by central member 46 extends laterally across the central portion of bottom portion 31 to define the corresponding inner support rail for the opposite worklight head. That is, horizontal surface 47 provides a central shelf with the two lateral edges of the shelf supporting the bezels of the two worklight heads.

In the illustrated embodiment front stops 38 and 48 provide for spacing between the top edge of the bezel and front wall 55 of the bottom portion. Here this spacing serves two purposes. For one, it provides room for the individual worklight handles 18, which extend beyond the top of the bezel. It also provides ventilation space for heat to disperse in the event the worklight is put into the case while still warm.

At the rear of bottom portion 31 is a recessed area or well 56 extending the width of the interior of the bottom portion for receiving the tripod. The forward border of the tripod well is defined by a low, laterally extending rail 57. Central member 46 slopes down to meet rail 57, and side member 36 also terminates before reaching rail 57. The tripod may be positioned in the well 56 in its retracted configuration so that bracket 19 at one extremity approximately abuts against interior side wall 42 of the bottom portion and feet 58 of tripod legs 59 at the other extremity of the tripod approximately abut against the opposite interior side wall. Sufficient space is allowed in well 56 for the front feet 12 of the worklight base to rest on the bottom of the bottom portion. The tubular members 13 extend approximately vertically, and the worklight base member and mounting brackets 60 for the worklight heads pass over the tripod to hold it in position. Adequate space remains between the two worklight heads for handle 16, electrical outlet box 23 and cord 24.

Top portion 32 is formed with a central, slightly raised portion 61, which serves to provide structural integrity to the case. Similarly, side members 62 serve primarily to provide structural integrity and in the illustrated embodiment do not play any substantial role in constraining the worklight, although they could be formed for this purpose in other embodiments for other shapes of worklights.

The edges of the top and bottom portions are formed in known fashion with an interference fit of mating edges 63 and 64 for snugly closing the case.

Figure 4:
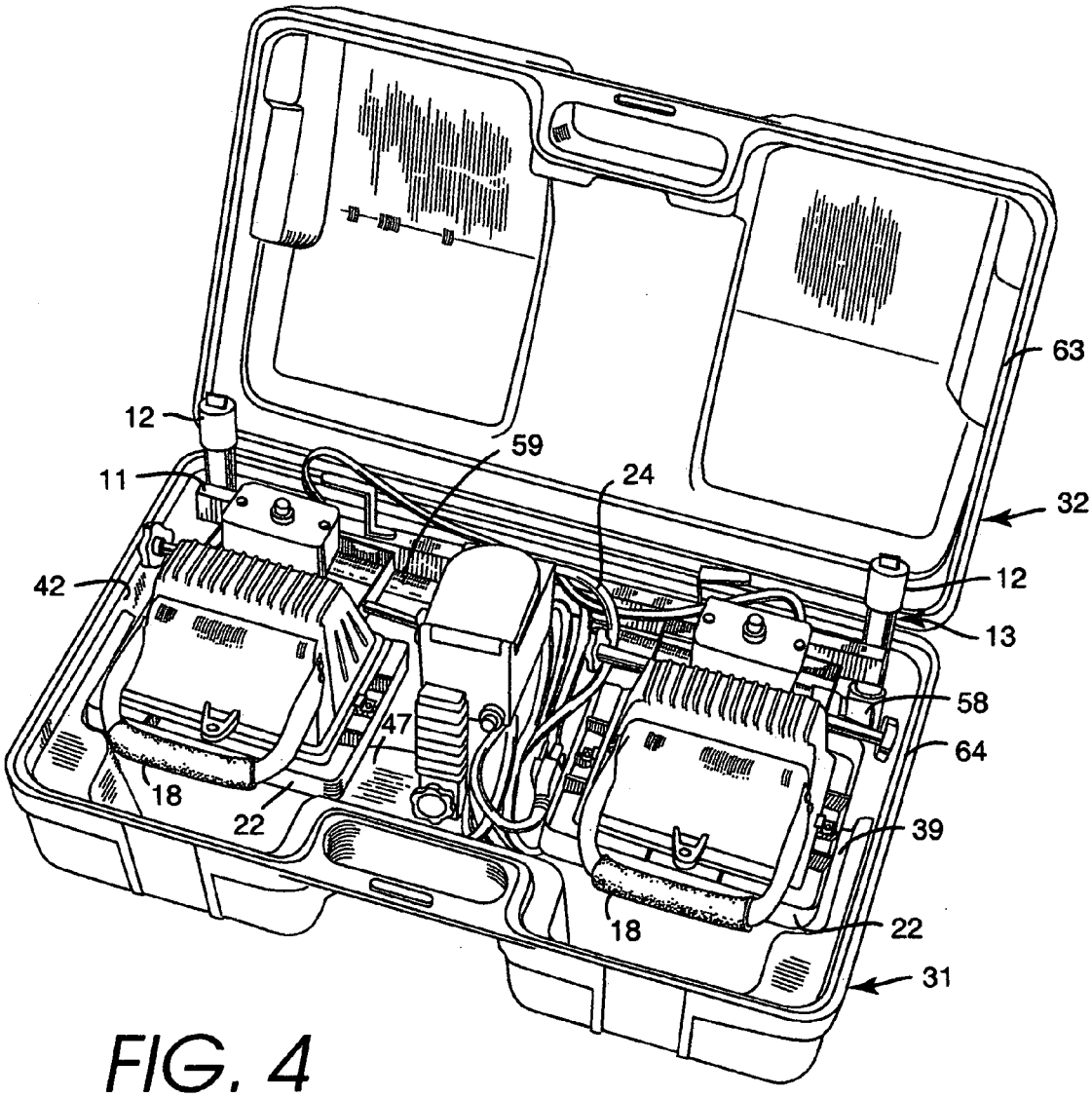
FIG. 4 is an overall view of a worklight positioned in the case.

The worklight shown in FIGS. 1 and 4 is of the type commonly referred to as a quartz halogen worklight. The present invention is especially advantageous for use with such quartz halogen worklights. These lights are characterized in that the light is generated by a so-called quartz halogen bulb. These bulbs are advantageous in that they provide longer life, greater luminous efficacy, higher color temperature, and little or no light depreciation with age. As a tradeoff, they run at a hotter temperature. The protective grill in part provides protective spacing from the hot window of the light bulb chamber. The present invention takes advantage of the protective spacing provided by the protective grill. Since the grill remains in position on the worklight head when placed in the case, the hot window does not come in close proximity to the case walls or any paper or other materials that may also be put in the case.

In the embodiment disclosed here it is also advantageous that the worklight is supported in the case at the bezel and not by the protective grill, which tends generally not to be as sturdy as the bezel. This avoids placing undue stress on the grill and its attachment to the worklight head.

For economical manufacture the case bottom portion may generally be blow-molded in a one-piece construction. Nevertheless, in some embodiments it may be desirable to form the worklight head bays as an insert to be secured in a separately molded bottom portion shell.

The above descriptions and drawings are given to illustrate and provide examples of various aspects of the invention in various embodiments. It is not intended to limit the invention only to these examples and illustrations. Given the benefit of the above disclosure, those skilled in the art may be able to devise various modifications and alternate constructions that although differing from the examples disclosed herein nevertheless enjoy the benefits of the invention and fall within the scope of the invention, which is to be defined by the following claims.

What is claimed is:

1. A case for carrying a worklight having a pair of worklight heads mounted on a common base, each said worklight head including a light bulb chamber and a protective grill protruding in front of the light bulb chamber and said worklight includes a carrying handle secured to said common base and extending generally between said worklight heads, characterized in that:

the case has a bottom portion including a pair of bays, each said bay being formed for receiving an individual worklight head with said protective grill in position on said worklight head in front of said light bulb chamber, and said bays being disposed in said bottom portion so that each of said worklight heads rests in its own bay when said worklight is in position in said bottom portion, and said pair of bays being formed and disposed to receive said pair of worklight heads while said worklight heads are mounted on said common base, wherein said case is formed to receive said pair of worklight heads in said pair of bays with said carrying handle extending therebetween, and wherein said common base has a longitudinal axis running generally between said worklight heads and said worklight includes at least two tubular members affixed to said common base proximate the outlying ends of said common base and extending generally perpendicular to said longitudinal axis, said tubular members providing feet for supporting the worklight as a standalone unit, and said case is further characterized in that:

said case has a depth sufficient to receive said tubular members in their disposition extending generally perpendicular to said base longitudinal axis.

2. A case for carrying a worklight having a pair of worklight heads mounted on a common base, each said worklight head including a light bulb chamber and a protective grill protruding in front of the light bulb chamber, characterized in that:

the case has a bottom portion including a pair of bays, each said bay being formed for receiving an individual worklight head with said protective grill in position on said worklight head in front of said light bulb chamber, and said bays being disposed in said bottom portion so that each of said worklight heads rests in its own bay when said worklight is in position in said bottom portion, and said pair of bays being formed and disposed to receive said pair of worklight heads while said worklight heads are mounted on said common base, wherein said common base has a longitudinal axis running generally between said worklight heads and said worklight includes at least two tubular members affixed to said common base proximate the outlying ends of said common base and extending generally perpendicular to said longitudinal axis, said tubular members providing feet for supporting the worklight as a standalone unit, and said case is further characterized in that:

said case has a depth sufficient to receive said tubular members in their disposition extending generally perpendicular to said base longitudinal axis.

3. The case of claim 2 wherein said case is further characterized in that said bottom portion includes a generally centrally disposed raised portion defining an elevated flat surface between the bays of said pair.

* * * * *